United States Patent [19]

Hesse

[11] Patent Number: 4,909,770

[45] Date of Patent: Mar. 20, 1990

[54] TOY VEHICLE WITH AN ELECTRIC MOTOR

[76] Inventor: Kurt Hesse, Waldstrasse 36, D-8510 Fuerth/Bayern, Fed. Rep. of Germany

[21] Appl. No.: 295,804

[22] Filed: Jan. 11, 1989

[30] Foreign Application Priority Data

Jan. 12, 1988 [DE] Fed. Rep. of Germany ..... 3800568

[51] Int. Cl.[4] ..... A63H 17/26

[52] U.S. Cl. ..... 446/455; 446/484

[58] Field of Search ..... 446/441, 444, 445, 446, 446/448, 454, 455, 457, 465, 489, 484; 15/198

[56] References Cited

U.S. PATENT DOCUMENTS

| | | | |
|---|---|---|---|
| 1,675,617 | 7/1928 | Radinse | 15/198 UX |
| 2,167,068 | 7/1939 | Gueydan | 446/445 X |
| 2,993,299 | 7/1961 | Dingee, Jr. et al. | 446/444 |
| 3,086,319 | 4/1963 | Frisbie et al. | 446/446 |
| 3,202,109 | 8/1965 | Stewart | 273/86 B |
| 3,252,248 | 5/1966 | Zalkind | 446/441 |
| 3,486,271 | 12/1969 | Feikema | 446/455 |

FOREIGN PATENT DOCUMENTS

| | | | |
|---|---|---|---|
| 3602349 | 7/1987 | Fed. Rep. of Germany | 446/457 |
| 454989 | 6/1950 | Italy | 446/457 |

*Primary Examiner*—Robert A. Hafer
*Assistant Examiner*—Sam Rimell
*Attorney, Agent, or Firm*—Browdy and Neimark

[57] ABSTRACT

In a toy vehicle with an electric drive motor and with wiper contacts disposed on the chassis thereof, which are in contact with the drive motor and with electrical conductors embedded in the toy vehicle track, a plurality of wire sections made of an electrically conducting and resiliently elastic material and kept together along part of their length by means of a sleeve are used to assure the maintenance of contact between the toy vehicle and the toy vehicle track and the operational connection of the wiper contacts with the conductors.

7 Claims, 1 Drawing Sheet

TOY VEHICLE WITH AN ELECTRIC MOTOR

FIELD OF THE INVENTION

The invention relates to a toy vehicle with an electric motor and with wiper contacts provided on the chassis thereof which are connected with the motor and are in contact with electrical conductors placed in the toy vehicle track.

BACKGROUND OF THE INVENTION

It is known to put electrical conductors embedded in the toy vehicle track into contact with wiper contacts made of strips of a metallic web disposed on the toy vehicle. However, because of their inherent stiffness, the strips of metallic web have the disadvantage that the contact between the wheels which are steered and the toy vehicle track is often interrupted when the strips of metallic web are at an acute angle and steering cannot be accomplished at all or only incompletely, while at a shallow position the contact with the electrical conductors becomes difficult or is interrupted.

SUMMARY OF THE INVENTION

It is an object of the invention to provide more secure contact of the toy vehicle with the vehicle track and of the wiper contacts with the electrical conductors.

This object is attained according to the invention in that a plurality of corrugated wire sections, secured over part of their length by a sleeve and made of an electrically conductive and resiliently elastic material, are used as wiper contacts. Preferably, phosphor-bronze is used for the thread-like wire sections. In this manner brush-like slide contacts are created, the individual wire sections of which are used as contact elements independently of each other and which, because of their low restoring force, assure the maintenance of the toy vehicle on the toy vehicle track even at steep angles and at the same time a secure electrical contact with the electrical conductors. It has been shown that the corrugations advantageously influence the mechanical properties of the wire sections and, on the one hand, sharp bends are avoided and on the other hand sufficient bending, such as is required for contact with the electrical conductors, is possible.

Through the design of the toy vehicle it is provided that the radius of the wire section corrugations is in general one millimeter when the free length of the wire sections is approximately 10 millimeters. It is understood that the corrugations can be also made with a smaller or larger radius. The size of the corrugations may depend on the free length of the wire sections.

To assure secure contact of the individual wire sections with the electrical conductors leading to the motor, the sleeve surrounding the wire sections is made of a material having a high degree of electrical conductivity. Copper is considered to be a suitable material.

Finally, it is also provided to support the sleeves of the wiper contacts on inclined surfaces disposed in recesses of the chassis and to keep them removable by means of clamping bodies fixed on the chassis. In a practical manner, the clamping bodies can be fixed by gripping from behind protrusions formed as part of the chassis. In this way the clamping bodies can be fixed on the vehicle chassis without tools or clamping means.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWINGS

The invention of the present application will now be described in more detail with reference to the preferred embodiments of the device, given only by way of example, and with reference to the accompanying drawings, in which.

DETAILED DESCRIPTION OF THE PREFERRED EMBODIMENT

Figures 1, 2, 3, 4, 5, 6:
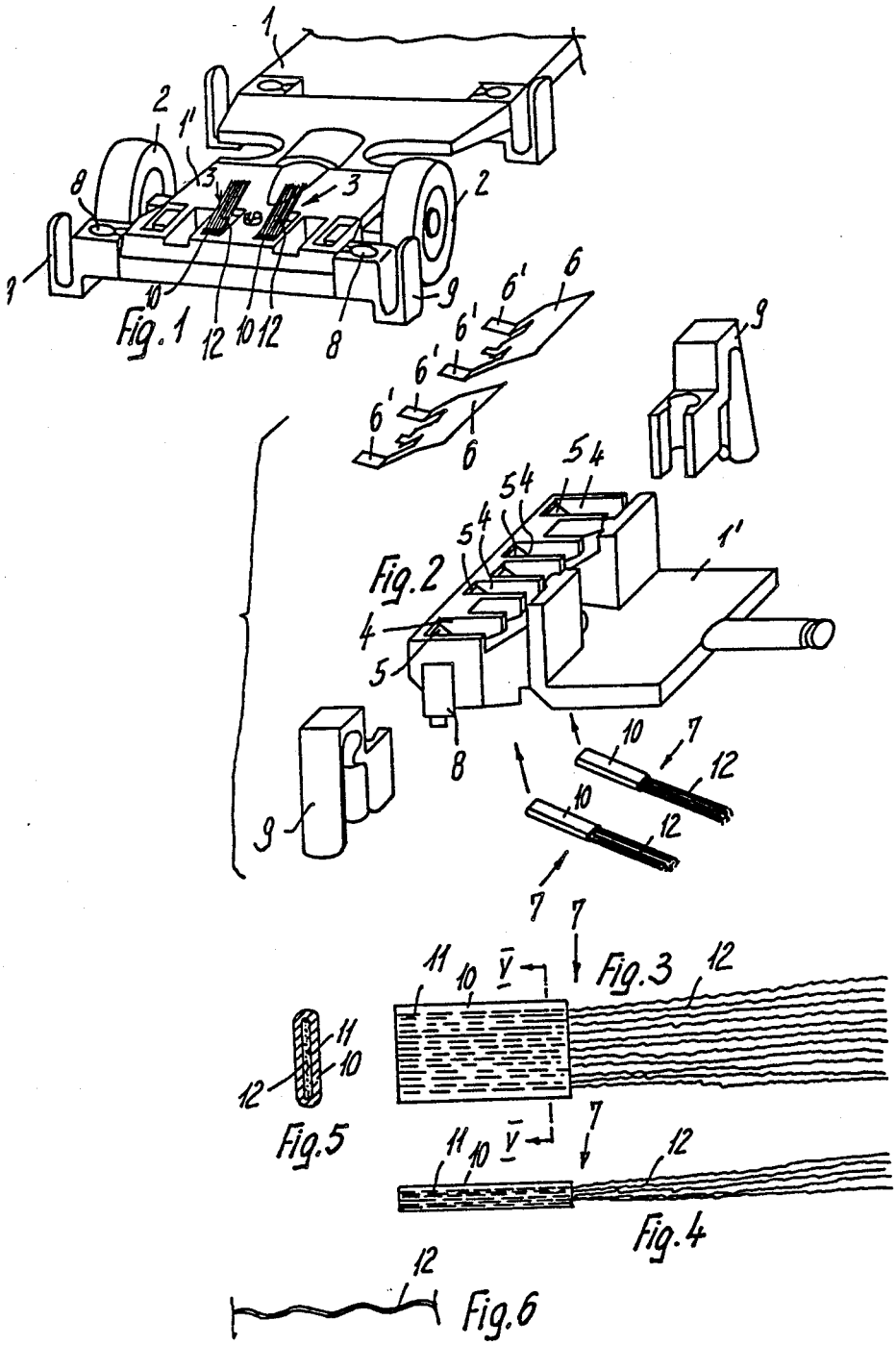
FIG 1 is a perspective bottom view of a part of a toy vehicle with wiper contacts.
FIG. 2 is a perspective top view of a part of a toy vehicle with wiper contacts.
FIG. 3 is an enlarged top view of a wiper contact.
FIG. 4 is an enlarged lateral view of a wiper contact.
FIG. 5 is section along the line V—V of FIG. 3.
FIG. 6 is a greatly enlarged section part of a wire.

A chassis of the toy vehicle is designated with 1 in the drawings and it is movable on toy vehicle tracks (not shown) by means of the wheels 2. In a manner known per se, the chassis I supports an electric motor (not shown) as driving means, which is connected with wiper contacts 3 via electrical conductors. The wiper contacts 3 extend obliquely towards the rear and downwardly beyond the bottom of the chassis 1 in order to contact, with their free ends, electrical conductors embedded in the toy vehicle track and connected with a power source.

In the exemplary embodiment, the chassis 1 has recesses 4 with inclined surfaces 5 (FIG. 2) on which wiper contacts 7 can be disposed and fixed by means of clamping bodies 6. The clamping bodies 6 are made of formed sheet metal parts and have notches 6' which press against the wiper contacts 7. Fixing of the clamping bodies 6 is accomplished in that projections are formed on a wall of the chassis 1 which grip the bodies 6 at a rear portion thereof. In FIG. 2 the recesses 4 are disposed on a pivotable chassis part 1', on which guide projections 9 for the toy vehicle are held on guide rails by means of pegs 8.

The wiper contacts 7 have a flattened sleeve 10 which, according to FIGS. 3 to 5, hold a plurality, e.g. 110 pieces, of individual wire sections 12, made of a resiliently elastic metallic material, in a central opening 11. Phosphor-bronze is used as a suitable material for the wire sections 12. The wire sections 12 are corrugated, the corrugation being arbitrary, and preferably have a radius of one millimeter when the free length is 10 millimeters. The sleeve 10 surrounding the wire sections 12 is made of copper which assures a secure contact between the sleeve 10 and the wire sections 12. It can be seen in FIG. 6 that the corrugation of the wire sections 12 is approximately sinusoidal. It is in accordance with the invention to select a larger corrugation radius with larger wiper contacts.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A toy vehicle for running on a toy vehicle track, the vehicle having a chassis and an electric motor and comprising a plurality of wiper contacts provided on the chassis which are connected with the motor and are in contact with electrical conductors placed in the toy vehicle track, each of said wiper contacts comprising a plurality of corrugated wire sections, made of an electrically conductive and resiliently elastic material, and at least one sleeve for holding said wire sections together along a portion of their lengths.

2. A toy vehicle in accordance with claim 1, wherein the wire sections are made of phosphor-bronze in the form of threads.

3. A toy vehicle in accordance with claim 1, wherein the radius of the wire section corrugation is approximately one millimeter when the free length of the wire sections is approximately 10 millimeters.

4. A toy vehicle in accordance with claim 1, wherein the sleeve containing the wire sections is made of a material with a high degree of electrical conductivity.

5. A toy vehicle in accordance with claim 1, further comprising recesses in the chassis having slanted surfaces for supporting the sleeves of the wiper contacts and clamping bodies fixed on the chassis for removably maintaining the wiper contacts on the chassis.

6. A toy vehicle in accordance with claim 5, wherein the clamping bodies are provided by formed sheet metal parts and further comprising projections formed on the chassis for fixing the clamping bodies on the chassis by gripping a rear portion of the bodies.

7. A toy vehicle in accordance with claim 1, wherein said corrugated sections are made of a wire which allows sufficient bending and low restoring force which is required for contact with said electrical conductors.

* * * * *